United States Patent [19]

DeVincentis

[11] Patent Number: 4,557,619

[45] Date of Patent: Dec. 10, 1985

[54] HAIRBRUSH AND AEROSOL SPRAY ASSEMBLY

[76] Inventor: Cheryl H. DeVincentis, 1012-21 Metropolitan Ave., Forest Hills, N.Y. 11357

[21] Appl. No.: 612,903

[22] Filed: May 22, 1984

[51] Int. Cl.[4] ..... A46B 11/02

[52] U.S. Cl. ..... 401/190; 401/287; 132/112

[58] Field of Search ..... 401/131, 190, 137, 287; 132/112, 116, 85

[56] References Cited

U.S. PATENT DOCUMENTS

| | | | |
|---|---|---|---|
| Re. 25,585 | 5/1964 | Birch et al. | 401/190 |
| 880,785 | 3/1908 | Fields | 401/287 |
| 2,998,822 | 9/1905 | Birch et al. . | |
| 3,184,781 | 5/1925 | Hoxie . | |
| 3,363,968 | 1/1916 | Willams . | |
| 3,387,341 | 6/1968 | Mates et al. | 401/131 X |
| 3,544,226 | 12/1901 | Kellis . | |
| 3,609,050 | 9/1928 | Alexander . | |
| 3,612,706 | 10/1971 | Verga | 401/190 |
| 3,653,090 | 4/1904 | Weaver . | |
| 3,856,027 | 12/1924 | Legere . | |
| 3,868,188 | 2/1925 | Velardi . | |
| 3,973,853 | 8/1910 | Myers . | |
| 4,013,369 | 3/1977 | Turek | 401/190 X |
| 4,252,455 | 2/1924 | de la Pena . | |
| 4,254,738 | 3/1981 | Stanley | 401/190 X |
| 4,399,827 | 8/1923 | Fuhs . | |

FOREIGN PATENT DOCUMENTS

| | | | |
|---|---|---|---|
| 2037187 | 2/1972 | Fed. Rep. of Germany | 401/190 |
| 2406800 | 5/1973 | Fed. Rep. of Germany | 132/85 |
| 2236448 | 2/1975 | France | 401/190 |

OTHER PUBLICATIONS

"Two-in-One: Hairbrush and Spray Pump," Glamour—7/84—p. 38.

*Primary Examiner*—Steven A. Bratlie

*Attorney, Agent, or Firm*—Anthony J. Casella; Gerald E. Hespos

[57] ABSTRACT

A hairbrush and aerosol spray assembly is provided which enables efficient use of both the brush and the hair spray with one hand, while also enabling easy removal and replacement of the spray can. The brush includes a hollow generally cylindrical core with bristles extending radially outwardly therefrom. The core is attached to a base which in turn is detachably mounted to the aerosol spray can. A nozzle assembly including a plurality of nozzles in communication with one another is centrally and removably disposed within the cylindrical core and in communication with the nozzle of the aerosol spray can. The spray can be activated by a trigger lever disposed adjacent to the base of the brush or by an extension of the nozzle assembly which protrudes beyond the cylindrical core of the brush.

15 Claims, 11 Drawing Figures

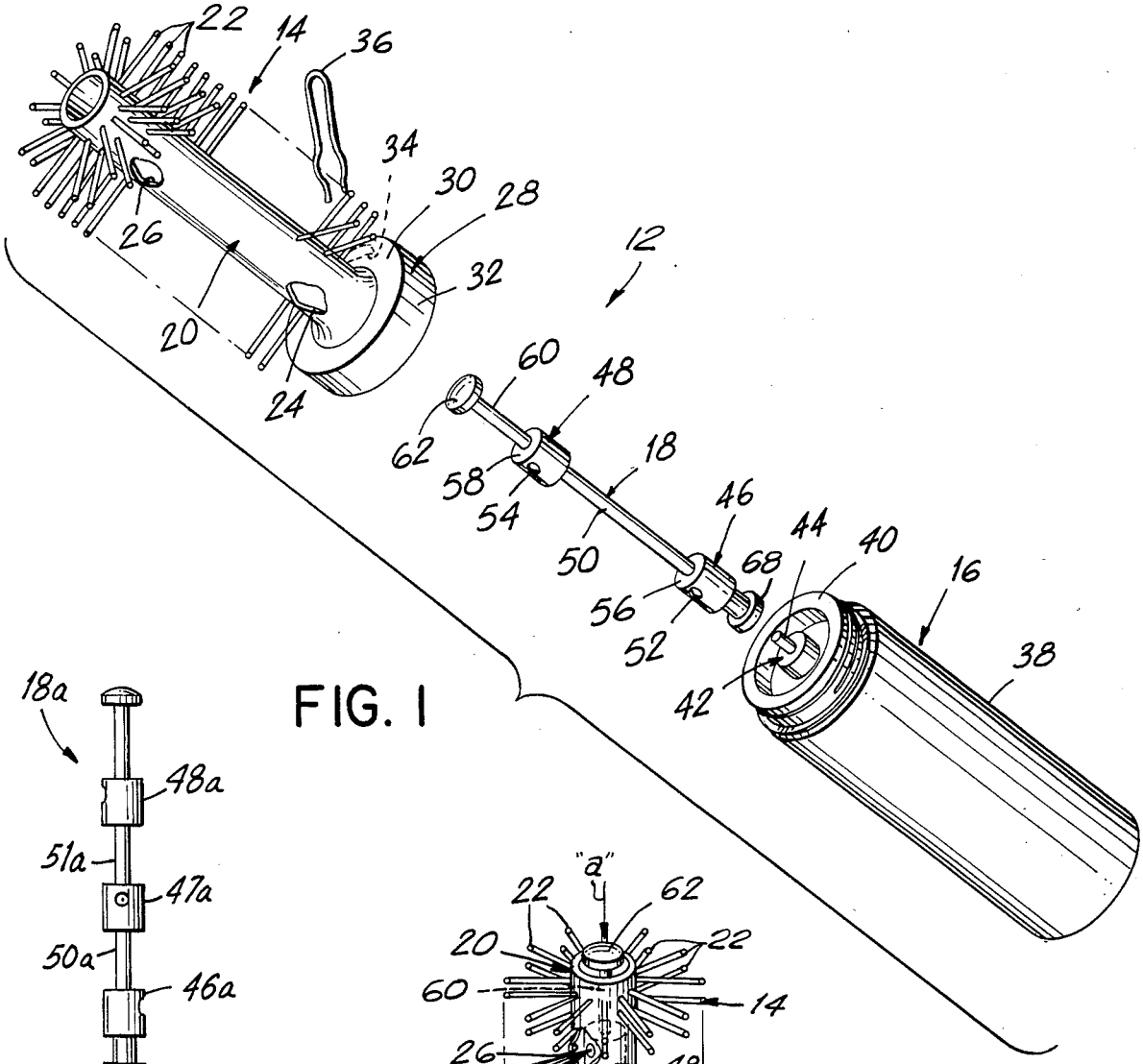
FIG. 1
FIG. 1a
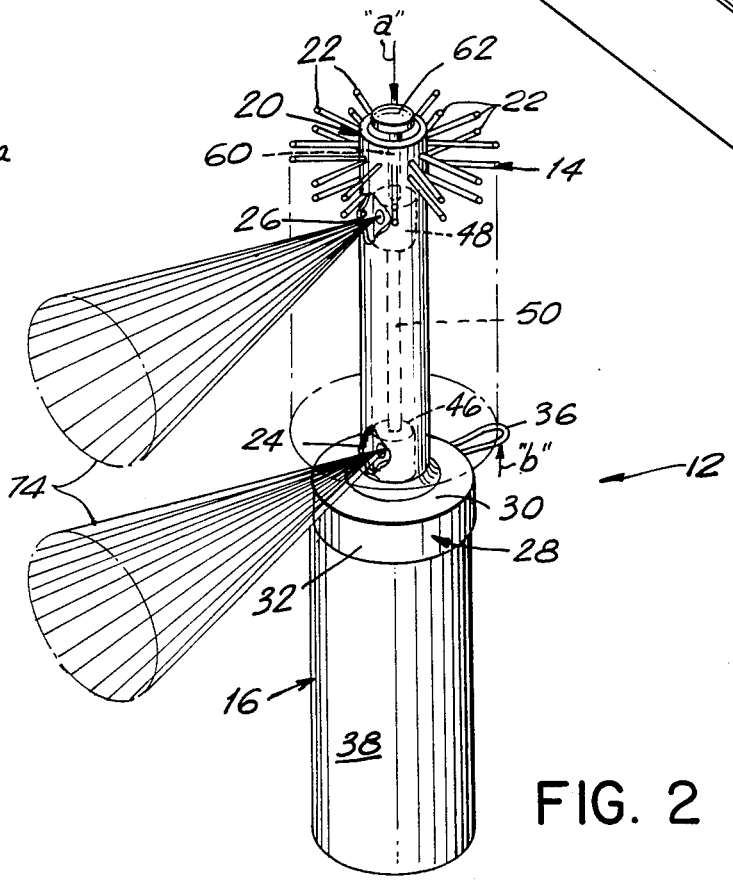
FIG. 2

HAIRBRUSH AND AEROSOL SPRAY ASSEMBLY

BACKGROUND OF THE INVENTION

Aerosol hair sprays are used by millions of women and men on a daily basis as part of their personal grooming. Additionally, most beauticians, hairstylists and barbers use hair sprays on their clientele. Typically the aerosol hair spray is used to provide additional body to the hair, thereby making the hair easier to style. However in many instances the aerosol hair spray is used to apply a coloring medium, a conditioner or a medicant.

The aerosol hair spray sends a colloidal mixture of gas and tiny liquid droplets toward the hair. The gas principally functions to transport the liquid in the desired direction. The liquid droplets, on the other hand, actually are applied to the hair. The aerosol nozzle used with hair sprays is constructed to project the liquid droplets in a cone-shaped array. Furthermore the droplets must be sufficiently small and sufficiently dispersed to avoid saturating or caking on any one part of the hair.

The hair spray invariably is used in conjunction with a hairbrush. Typically the spray is applied immediately before or during the brushing of the hair. Thus, the spray alters the physical characteristics (e.g. body) of the hair while the brush works the hair into the preferred style. A very useful brush for styling hair includes a generally cylindrical core with bristles extending generally radially outwardly in all directions along the length of the core. Brushes of this shape are particularly useful to impart waves, curls or a fluffy body that might otherwise not be present. These brushes can be pulled through the hair in a direction perpendicular to the cylindrical core, and/or rotated around the axis of the core.

The styling of hair also typically includes the use of a blow dryer. The blow dryer directs a stream of warm or hot air, and thus can be used to dry the hair after a shampoo or shower. The blow dryer also performs a significant styling function, and often is used even though the hair is not wet. More particularly the blow dryer fluffs up the hair enabling it to be worked into the desired style.

For many people, the daily grooming exercise involves the sequential use of a blow dryer, a hair spray and a generally cylindrical styling brush. The particular sequence of using these tools will vary according to the specific styling effect desired. As an example, the hair may initially be dryed or fluffed up with the blow dryer and the cylindrical styling brush. The styling brush and spray may then be used simultaneously to provide the desired body and at least initial shape to the hair. The brush may then be used either along or in conjunction with the blow dryer to perform the final styling steps. The spray may then be used alone afterwards to render the particular style more permanent. In many instances the above recited sequence, or one similar to it, will be performed repeatedly on one section of hair after another until the desired overall grooming effect is achieved.

It should be emphasized that the amount and type of hair spray used is dependent upon the personal tastes of the individual, the desired hairstyle and many other variables including weather and planned activities. Thus, in certain instances a light spraying may be acceptable, whereas in others a more complete spraying of each strand of hair will be performed. Furthermore, as noted above, the hair spray is not always used merely to impart body to the hair. In many instances a spray will be used to place a conditioner or medicant on the hair, or even to dye all or parts of the hair. A proper droplet size and dispersal pattern always is essential.

The above described sequential use of blow dryers, sprays and hairbrushes requires an unusual degree of dexterity. The person carrying out the daily grooming exercise will repeatedly be picking up or laying down the blow dryer and the hair spray. The dryer or hair spray canister may be placed on a sink, a dressing table or between the user's legs during these brief periods of disuse. For the beautician, hairstylist or barber, this is a particularly bothersome exercise, since it occupies a large part of the day for these individuals.

Attempts have been made to combine a spray applicator into a brush to minimize the number of tools that must be worked with, or to facilitate a more complete application of material. For example, U.S. Pat. No. 2,998,822, which issued to Birch et al shows a brush or comb having an aerosol spray can mounted within a substantially enclosed handle structure. More particularly, the brush of U.S. Pat. No. 2,998,822 includes a handle having a hollow chamber that can be opened to receive an aerosol cartridge. A duct is incorporated into the brush, and extends from the chamber to the portion of the brush having the bristles. The end of the handle opposite the bristles includes a button which extends into the chamber. A pressure exerted on the button will cause the cartridge to move within the chamber. A sufficient movement of the cartridge will trigger a release of the material into the duct, thereby enabling a flow of materials through the area of the brush from which the bristles extend. The brush of U.S. Pat. No. 2,998,822 includes several defficiencies. For example, the hollow handle is costly to manufacture and can receive only a single size cartridge. Additionally, the duct construction is even more costly, is subject to failure and will achieve an undesired application pattern. Specifically, the narrow duct which is integral to the brush body is costly to manufacture and can easily be blocked by material being sprayed from the cartridge. A blockage of this narrow duct will render the entire costly assembly useless. Furthermore, the construction of the duct enables only a narrow stream of material to be emitted from the brush shown in U.S. Pat. No. 2,998,822. This flow pattern is entirely inconsistent with the wide broadcasting of spray material that is essential to proper hairstyling. Finally, the positioning of the activator button in U.S. Pat. No. 2,988,822 makes activation of the spray extremely cumbersome for either an individual doing their own hair or a hairstylist working on someone else. Specifically, the bristles part of the brush invariably is held toward the thumb side of the hand. Consequently the activator button would be adjacent the outside portion of the hand making activation of the assembly extremely difficult.

Another brush applicator is shown in U.S. Pat. No. 3,973,853 which issued to Myers. The structure shown in U.S. Pat. No. 3,973,853 is a complex arrangement of brackets, spring-actuated levers, ducts and an array of nuts and bolts. The brush of U.S. Pat. No. 3,973,853 includes a brush portion and a handle portion. Brackets adapted to receive an aerosol spray can are disposed on the side of the brush portion opposite the bristles. A complex arrangement of brackets extends over the aerosol spray nozzle and connects to a lever disposed adjacent the handle of the brush. A duct then extends from the aerosol spray nozzle and through the array of bristles. The duct includes a plurality of apertures for dispensing material from the spray can. The structure shown in U.S. Pat. No. 3,973,853 would make mounting and removal of the can extremely difficult to accomplish. Furthermore, the complex arrangement of levers and brackets would invariably become snarled in the hair, making use of this apparatus a painful experience. Additionally, the positioning of the activator handle would make it difficult to properly use the brush in a nonspraying mode. Similarly, the required positioning of the aerosol can with respect to the bristles would make this structure impossible to use with the preferred generally cylindrical styling brush. Finally, the arrangement of the apertured duct would not provide the desired spray pattern for use in hair grooming applications.

Several structures have been developed to enable the dispensing of shaving cream or toothpaste from an aerosol can and through a brush member. For example, U.S. Pat. No. 3,609,050 shows a clamp member that can be affixed to an aerosol can of shaving cream. A brush also is mounted to the clamp and aligned to the stream of shaving cream. Thus the shaving cream will flow through the brush and onto the individual. Similar structures are shown in U.S. Pat. No. 3,363,968 which issued to Williams, U.S. Pat. No. 3,653,090 which issued to Weaver and U.S. Pat. No. 4,252,455 which issued to de la Pena. A comparable structure for use with toothpaste and a toothbrush is shown in U.S. Pat. No. 3,612,706 which issued to Verga. In this structure, a toothbrush assembly is threadably attached to an aerosol canister. The aerosol canister is activated by bending the nozzle away from its initial axial alignment. A duct within the toothbrush assembly telescopingly engages the nozzle of the aerosol canister. Toothpaste can be urged through the duct and up into the area of the bristles. A similar structure for use with toothpaste and toothbrushes is shown in U.S. Pat. No. 3,868,188.

The flow characteristics and desired application patterns of shaving cream and toothpaste differ from the flow characteristics and application pattern for hair spray. Consequently the above cited references do not suggest a structure that could conveniently and properly be used to apply hair spray, particularly with the preferred styling brush.

An apparatus for applying upholstery shampoo from an aerosol can is shown in U.S. Pat. No. 3,184,781. The applicator of U.S. Pat. No. 3,184,781 is mounted on the top of an aerosol can. The applicator includes an activator button and an applicator sponge surrounded by bristles. By depressing the activator button the shampoo can be urged through an array of ducts and into the general area of the sponge. The sponge absorbs the shampoo and enables application of the shampoo onto the upholstery. Appropriate movement of the entire aerosol can and applicator enables a proper working of the shampoo into the upholstery. As described previously, the flow characteristics of shampoo into upholstery are entirely different from the desired flow characteristics of an aerosol hair spray. Consequently the applicator shown in U.S. Pat. No. 3,184,781 is of little help in suggesting a structure which conveniently can combine a brush assembly and an aerosol spray can for grooming hair.

U.S. Pat. No. 4,254,738 which issued to Stanley shows a pump spray applicator for applying a liquid to a pet. The structure shown in U.S. Pat. No. 4,254,738 includes a brush portion and a case into which a pump spray bottle is received. The pump actuator extends through the structure enabling a pumping of liquid from the bottle into the brush area of the applicator.

U.S. Pat. No. 3,544,226 which issued to Kellis, and U.S. Pat. No. 4,399,827 which issued to Fuhs show structures for holding a liquid and applying that liquid through a brush.

U.S. Pat. No. 3,856,027 which issued to Legere shows a composite structure for holding both an aerosol spray and a comb. The spray and the comb do not act in cooperation with one another.

In view of the above it is an object of the subject invention to provide an aerosol spray and brush assembly to facilitate an efficient application of a hair spray.

It is another object of the subject invention to provide a combination aerosol spray and brush assembly that can be activated easily for applying a spray either to the hair of the individual holding the apparatus or to the hair of another.

It is an additional object of the subject invention to provide a combination aerosol spray and hairbrush that can be activated in more than one way.

It is a further object of the subject invention to provide a combination aerosol spray and hairbrush that will provide an optimal spray pattern.

It is still another object of the subject invention to provide a combination aerosol spray and hairbrush that can be easily altered to achieve different spray patterns.

It is still a further object of the subject invention to provide an aerosol spray can and hairbrush that is not subject to clogging.

It is still an additional object of the subject invention to provide an aerosol spray can and hairbrush assembly that can easily be assembled.

It is yet another object of the subject invention to provide an aerosol spray and hairbrush assembly wherein the brush is a generally cylindrical brush well adapted to styling hair.

SUMMARY OF THE INVENTION

The subject invention is directed to the combination of a generally cylindrical styling hairbrush which is attachable to an aerosol can of hair spray such that the hair spray can effectively function as the handle of the hairbrush. The brush member of the subject assembly includes a plurality of bristles extending radially outwardly along the length of the cylindrical brush from a generally cylindrical core member. The core member is a hollow walled structure which is fixedly mounted to a base. The base in turn is detachably mounted on the aerosol can.

An aerosol nozzle assembly is centrally mounted within the hollow cylindrical core of the brush. The nozzle assembly includes a plurality of aerosol spray nozzles which are in communication with one another such that each provides the desired widely dispersed aerosol spray. Preferably the nozzles in the nozzle assembly are connected to one another by a tube means. The nozzles may be disposed to spray in the same general direction, or alternatively may be angularly separated from one another. The particular alignment of the individual nozzle heads will be a function of the desired effect to be achieved by the spray.

The nozzle assembly may be placed on or removed from the nozzle of the spray can in the standard manner for each particular can. In most instances this is a simple telescoping of the nozzle head over a generally tubular nozzle member on the can. The lowermost nozzle head in the nozzle assembly is frictionally maintained in its position on the spray can.

The base of the brush can be secured to spray can by any of several available means. In one embodiment the brush is threadably secured to the spray can. Thus, the brush and the can would be manufactured with compatible threaded structures.

In another embodiment the brush and spray can are detachably secured to one another by compatible hooks and loops biased into interlocking arrangement. More particularly the can includes a plurality of locking loops while the brush base includes compatible locking loops. A spring is interposed between the can and the brush base. The brush is mounted to the can by depressing the spring and rotating the brush such that the hooks on the brush engage the engage on the can. The biasing force of the spring holds the protrusions in interlocking engagement.

In still another embodiment the brush is frictionally engaged onto the can. The proper alignment of the holes on the brush can be assured by using key ways and keys on the brush and the can respectively.

Another embodiment employs hook-connecting fabrics, such as the fabrics sold under the name VELCRO. For example the base could include a generally cylindrical side wall a portion of which is formed from a hooked fabric member. A looped fabric member then could be attached to the can by an appropriate means, such as adhesive. The brush can be securely mounted to the can by wrapping the hooked fabric side wall of the brush base around the looped fabric member attached to the can.

The brush and aerosol spray assembly of the subject invention is adapted to be activated in at least one, and preferably two, ways. In one embodiment, the nozzle assembly extends a sufficient distance beyond the end of the brush. This extension of the nozzle assembly then can be pushed toward the can to activate the spray. It is anticipated that in the typical usage of the subject brush and hair spray assembly that this extension of the nozzle assembly would be depressed by the other hand of the person holding the assembly. Thus, the brush and can assembly could be manipulated by the the user's right hand while the heel of the user's left hand touches the nozzle assembly extension. It must be remembered, that this other hand in many instances would be holding a blow dryer. The presence of the blow dryer in the second hand does not appreciably affect the ability of the user to depress the nozzle extension.

An alternate means of activating the spray is in the form of a trigger lever which is passed through the brush base, and is in contact with the nozzle structure of the spray can. The trigger can be rotated away from the can by, for example, the thumb of the hand with which the can is being held. The aperture in the brush base is dimensioned such that this upward rotational movement of the trigger lever causes an opposite rotational movement against the nozzle structure of the can. Thus, the brush base effectively functions as a fulcrum. The movement of the trigger lever against the nozzle portion of the can activates the spray. The spray can be stopped merely be releasing the trigger lever.

The use of either one of the above described spray activating members does not preclude the use of the other. In fact, in most instances the subject structure would be formed to enable both types of activation. It is anticipated that people styling their own hair would be more inclined to use the trigger lever. However, it also is anticipated that a beautician or hairstylist working on someone else's hair would be more inclined to depress the nozzle extension against their second hand, which typically would be the hand holding the blow dryer.

The subject brush and hair spray assembly could be sold as a unit or as two separate members. The aerosol spray can could readily be removed from the brush assembly once the spray has been entirely used. A refill spray then could be attached to the brush assembly. Alternatively aerosol spray cans could be interchanged with one another for the particular hairstyling need. Similarly the brush and nozzle assemblies could be interchanged to insure that the desired brushing and spraying functions are carried out.

BRIEF DESCRIPTION OF THE DRAWINGS

FIG. 1 is an exploded perspective view of the brush and spray assembly of the subject invention.

FIG. 1*a* is an elevational view of an alternate nozzle assembly.

FIG. 2 is a perspective view of the brush and spray assembly shown in FIG. 1.

DETAILED DESCRIPTION OF THE PREFERRED EMBODIMENTS

Figure 3:
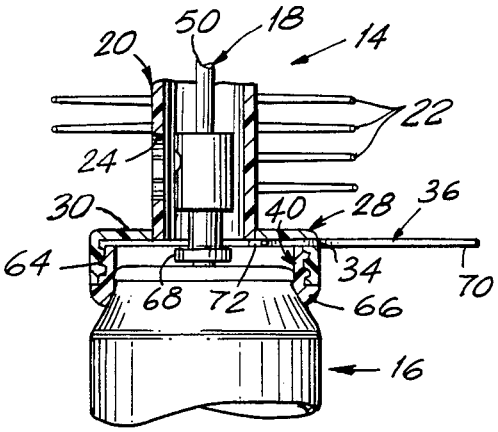
FIG. 3 is a cross-sectional view of the brush and spray assembly shown in FIG. 1.

The hairbrush and aerosol spray assembly of the subject invention is indicated generally by the numeral 12 in FIG. 1. The hairbrush and spray assembly 12 includes a brush 14, an aerosol spray can 16 and a nozzle assembly 18.

The brush 14 of the brush and aerosol spray assembly 12 is of generally cylindrical construction. More particularly the brush 14 includes a hollow generally cylindrical core 20 from which a plurality of bristles 22 extends radially outwardly. The bristles 22 extend substantially entirely along the length of core 20 and are angularly spaced substantially entirely around core 20. The core 20 includes spray apertures 24 and 26, which as explained further below, enable the proper dispersion of spray from the aerosol spray can 16.

The brush 14 also includes a brush base 28. Brush base 28 is a generally cylindrical structure having an annular top wall 30 to which the core 20 is fixedly mounted. The central opening in the annular top wall 30 is of sufficient dimension to enable the nozzle assembly 18 to pass therethrough as explained further below. The brush base 28 further includes a generally cylindrical side wall 32. The cylindrical side wall 32 and the annular top wall 30 are fixedly secured to one another.

The brush base 28 further includes a trigger aperture 34 extending into the cylindrical side wall 32. The trigger aperture 34 typically will be disposed substantially 180° opposite the spray apertures 24 and 26. The trigger aperture 34 is dimensioned to receive the trigger lever 36 which activates the nozzle assembly 18 as explained herein.

Typically the entire brush 14 including the bristles 22 is formed from an integral plastic member.

The aerosol spray can 16 includes an elongated body 38 which preferably is dimensioned to be readily grasped by the user. For example, the 2.4 ounce hair spray cans which are readily available can easily be adapted to the purposes described herein. The 2.4 ounce aerosol spray cans are approximately 1.5" in diameter and approximately 4.5" long. Other dimensions that enable a comfortable grasping of the body portion 38 of can 16 in one hand are acceptable.

The aerosol spray can 16 includes a generally annular top 40. The top 40 of aerosol spray can 16 is adapted to mate with the brush base 32 of brush 14. Several preferred constructions of this mating are explained in detail in the following pages.

Disposed centrally within the top 40 is can nozzle structure 42. The can nozzle structure 42 extends into the aerosol spray can 16. The can nozzle structure 42 further includes a tube 44 through which a spray of gas and liquid droplets is dispensed. A spring (not shown) urges the tube 44 into an upward position. However a downward force on the tube 44 will cause the nozzle 42 to open, thereby enabling the aerosol spray can 16 to emit a stream of gas and liquid droplets.

The nozzle assembly 18 is adapted to mount over the tube 44 of the nozzle 42 of the aerosol spray can 16. More particularly, the nozzle assembly 18 includes nozzle heads 46 and 48 which are in communication with one another through tube 50. Nozzle heads 46 and 48 include spray apertures 52 and 54 respectively which are disposed substantially at right angles to the tube 50. As explained further below an aperture extending generally axially into the nozzle head 46 enables the nozzle head 46 to be slid into frictional telescoping relationship with the tube 44. The nozzle head 46 is constructed internally such that the spray emitted from tube 44 passes through the nozzle head 46 and is then emitted through spray aperture 52. The nozzle head 46 further includes a generally axially aligned aperture extending into the top portion 56 thereof. The tube 50 is inserted into the aperture in the top portion 56 of nozzle head 46 so as to be in communication with tube 44 on the aerosol spray can 6. Thus, the spray emitted from tube 44 will be divided to both the spray aperture 52 on the nozzle head 46 and to the tube 50. The relative proportions of spray being emitted through either the spray aperture 52 or the tube 50 can readily be controlled as a function of the internal construction of nozzle head 46.

Nozzle head 48 is substantially similar to nozzle head 46. Thus, the spray of material passing through tube 50 is emitted through spray aperture 54 on nozzle head 48. The nozzle head 48 also includes an aperture extending into the top portion 58 thereof. This aperture in the nozzle head 48 can be connected to a tube similar to tube 50 so that a proportion of the spray approaching nozzle head 48 can be diverted to other nozzle heads (not shown). As illustrated in FIG. 1, only two nozzle heads are provided. As a result a solid cylindrical member 60 extends from the aperture in the top portion 58 of nozzle head 48. To facilitate the depression of the entire nozzle assembly 18 a button 62 is securely mounted to the cylindrical member 60.

The diameters of the nozzle heads 46 and 48 and the button 62 are selected to enable the entire nozzle assembly 18 to be slideably inserted into the core 20 of the brush 14. Additionally, the length of tube 50 is selected to insure a proper alignment of the spray apertures 52 and 54 with the spray apertures 24 and 26 on brush 14.

As illustrated in FIG. 1 the nozzle heads 46 and 48 are disposed to direct spray in generally the same direction. However, as noted above, in many instances it may be desirable to have more nozzle heads and to direct a spray through a wider area. Thus, a greater number of nozzle heads may be provided and they may be positioned to direct their sprays at various angular positions with respect to one another as shown in FIG. 1*a*. Specifically FIG. 1*a* shows nozzle assembly 18*a* having nozzle heads 46*a*, 47*a* and 48*a* in communication with one another through tubes 50*a* and 51*a*.

The spray of the brush aerosol spray assembly 12 can be activated by exerting a downward force on the button 62 as directed by arrow "a" in FIG. 2. This downward force will act through the entire nozzle assembly 18 thereby causing an activation of the can nozzle 42 on aerosol spray can 16. Alternatively, an upward force on the trigger lever 36 in the direction indicated by arrow "b" also will cause an activation of the spray. This latter structure and function is described and illustrated in greater detail below.

Figure 5:
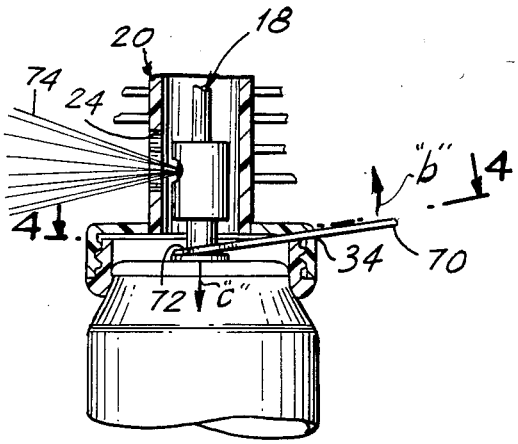
FIG. 5 is a cross-sectional view similar to FIG. 3 but showing a different stage during the operation of the subject assembly.
Figure 4:
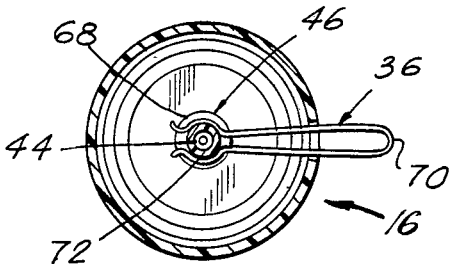
FIG. 4 is a cross-sectional view along line 4—4 of FIG. 5.

Turning now to FIGS. 3 through 5 one embodiment of the specific mating of brush 14, aerosol spray can 16 and nozzle assembly 18 is shown in detail. More particularly in the embodiment shown in FIGS. 3 through 5 the brush base 28 is provided with an array of internal threads 64. Similarly the top 40 of the aerosol spray can 16 is provided with a compatible array of external threads 66. Therefore the brush 14 can easily be threadably attached to the aerosol spray can 16. The relative dimensions and pitches of the arrays of threads 64 and 66 should be selected to enable a fairly secure mounting of brush 14 on aerosol spray can 16. Thus, the brush 14 will not become separated or misaligned with the aerosol spray can 16.

As shown clearly in FIGS. 3 through 5 the nozzle assembly 18 is dimensioned to fit within the core 20 of the brush 14. Thus, the nozzle assembly 18 can be moved axially up or down without being impeded by the core 20.

The nozzle head 46 of nozzle assembly 18 is provided with an annular ridge 68 disposed adjacent the end thereof closest to the aerosol spray can 16. The annular ridge 68 provides a surface against which the trigger lever 36 can exert a force. The trigger lever 36 can be urged upwardly as indicated by arrow "b" in FIG. 5. This upward movement of trigger lever 36 typically would be carried out by the thumb of the hand with which the subject brush aerosol spray assembly 12 is held. As the end 70 of the trigger lever 36 is urged upwardly, the portion thereof intermediate the ends 70 and 72 contacts the brush base 32 adjacent the opening 34 therein. As a result, the opposed end 72 of the trigger lever 36 rotates downwardly in a direction indicated by arrow "c" in FIG. 5. This downward movement of end 72 of trigger lever 36 causes a corresponding downward movement of the nozzle assembly 18 thereby creating a spray 74 which is directed through the spray aperture 24 in the core 20. A similar spray is emitted from the other nozzle heads.

The trigger lever 36 is constructed to engage the walls of the aperture 34 such that slideable movement of trigger lever 36 in aperture 34 is possible, but such that complete removal of the trigger lever 36 is not likely. The trigger lever 36 typically would be urged into the aperture 34 prior to the initial sale of the brush 14. The purchaser of the subject brush 14 or brush and aerosol spray assembly 12 could then slideably move the trigger lever 36 within the aperture 34 to achieve proper engagement of the end 72 thereof with the annular ridge 68. This structural configuration enables the user of the brush aerosol spray assembly 12 to disengage the trigger lever 36 in order to remove an empty aerosol spray can 16. A replacement aerosol spray can then could be engaged to brush 14 and can be activated by merely sliding the trigger lever 36 into its proper position. Alternatively, the trigger lever 36 could be used to lock the brush aerosol spray assembly into a condition where spraying is not possible. Specifically this is carried out by moving the nozzle assembly upward and out of close engagement with the nozzle 42 on the aerosol spray can 16. The trigger lever 36 then could be urged inwardly and under the annular ridge 68, thereby preventing a complete depression of the nozzle assembly 18. With the nozzle assembly unable to move downwardly into the condition illustrated in FIG. 5, the brush aerosol spray assembly 12 is effectively locked. This is convenient for carrying the brush aerosol spray assembly 12 in a pocketbook, suitcase or the like.

Figure 6:
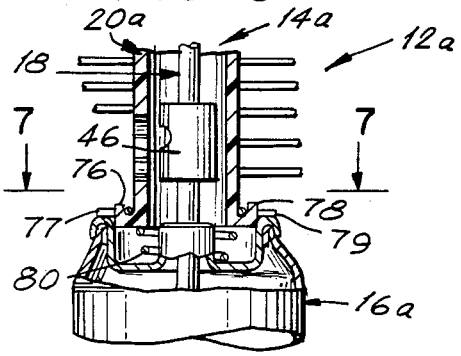
FIG. 6 is a cross-sectional view of an alternate embodiment of the brush and spray assembly of the subject invention.
Figure 7:
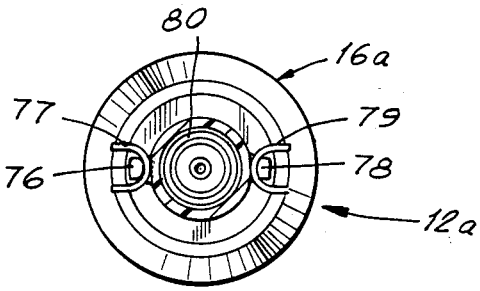
FIG. 7 is a cross-sectional view along line 7—7 in FIG. 6.

An alternate embodiment of the brush aerosol spray assembly is indicated by the numeral 12*a* in FIGS. 6 and 7. In this embodiment, the brush is indicated generally by the numeral 14*a* and includes a core 20*a* from which bristles 22 extend radially outwardly. The brush aerosol spray assembly 12*a* can be provided with a trigger lever similar to trigger lever 36 shown above. However, since trigger lever 36 is not essential to the operation of the aerosol spray assembly 12 or 12*a* it is not depicted in FIGS. 6 and 7.

The cylindrical core 20*a* terminates in a brush base defined by two upwardly extending locking hooks 76 and 78 which are disposed approximately 180° separated from one another. The aerosol spray can 16*a* is provided with a pair of locking loops 77 and 79 which are dimensioned to accept the locking hooks 76 and 78 respectively. A spring 80 is disposed intermediate the aerosol spray can 16*a* and the brush 14*a*. The spring 80 is dimensioned to exert a biasing force on the brush 14*a* when the hooks 76 and 78 are engaged respectively in the loops 77 and 79. More particularly the brush 14*a* can be positioned with respect to the aerosol spray can 16*a* such that the hooks 76 and 78 are not aligned with the loops 77 and 79. The brush 14*a* then can be urged toward the aerosol spray can 16*a* such that the spring 80 is biased into a compressed condition. The brush 14*a* then can be rotated such that the hooks 76 and 78 are angularly aligned with the loops 77 and 79. A release of the force on brush 14*a* causes the spring 80 to force brush 14*a* into locking engagement with loops 77 and 79. The force of spring 80 should be sufficient to prevent the accidental disengagement of brush 14*a* from aerosol spray can 16*a*. However, the spring 80 should not be so strong as to make the changing of aerosol spray can 16*a* difficult.

Figure 8:
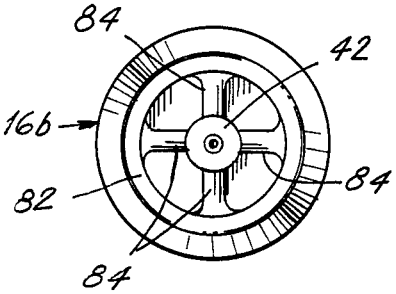
FIG. 8 is a top plan view of the aerosol spray can according to a third embodiment of the subject invention.
Figure 9:
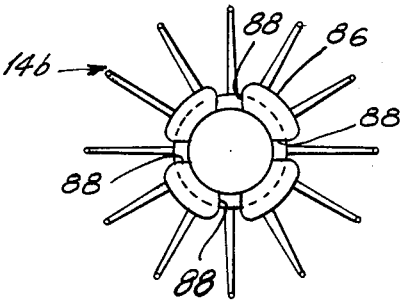
FIG. 9 is a plan view of the brush assembly compatible with the aerosol can shown in FIG. 8.

A third embodiment is illustrated in FIGS. 8 and 9. In this embodiment the aerosol spray can is indicated generally by the numeral 16*b* in FIG. 8. The top of aerosol spray can 16*b* is defined by can nozzle 42 and annular rim 82. A plurality of keys 84 extend generally radially between the can nozzle 42 and annular rim 82. Each key 84 effectively defines a raised ridge. Turning to FIG. 9, the brush is indicated generally by the numeral 14*b*. The brush base is defined by a generally circular member 86 which is disposed orthogonal to the axis of the brush 14*b*. The circular base member 86 is characterized by a plurality of keys ways 88 which are dimensioned to frictionally engage the keys 84 on the can 16*b*. More particularly the keys 84 and key ways 88 should be dimensioned to snap into engagement with one another. The aerosol spray can 16*b* can be changed in the embodiment illustrated in FIGS. 8 and 9 merely by forcing the brush 14*b* out of engagement with the keys 84, and snapping a new cap into proper position.

Figure 10:
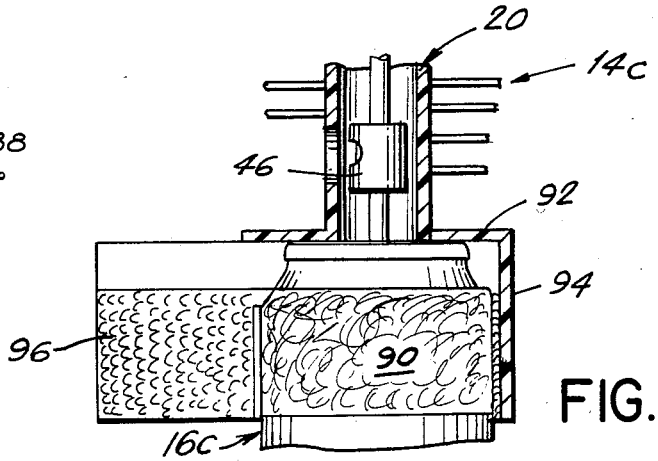
FIG. 10 is a cross-sectional view of a fourth embodiment of the subject brush and spray assembly.

A fourth embodiment of the subject invention is illustrated in FIG. 10. In this embodiment the can 16*c* is manufactured in the standard form with no structural members provided to accept the brush 14*c*. After complete manufacture of the standard can 16*c*, a continuous loop fabric 90 is applied to the can by appropriate means such as adhesive.

The brush 14*c* includes a cylindrical core 20 substantially similar to those described above. An annular base member 92 is securely affixed to the lower end of cylindrical core 20. A flange 94 is in turn affixed to the annular base member 92 adjacent the outer circumference thereof. The flange 94 defines an arc of a circle which may extend through approximately 90°. A hooked fabric fastener strip, such as the type sold under the trademark VELCRO, is attached to the inwardly facing surface of the flange 94 such that the hooks of fabric 96 also are facing inwardly. The fabric 96 should be of a length approximately equal to the circumference of the can 16*c*. The brush 14*c* then can be attached to the can 16*c* by merely positioning the flange 94 adjacent the continuous looped fabric 90 such that the hooked fabric 96 attaches to the loops of looped fabric 90. The remainder of the hooked fabric 96 then is wrapped circumferentially around the can and into secure attachment with the continuous looped fabric 90. Although the can 16*c* can be sold with the continuous looped fabric 90 affixed thereto, the can readily can be retrofitted into this condition by the consumer.

In summary a brush aerosol spray assembly is provided for use with hair sprays. The brush preferably is a cylindrical member with radially outwardly extending bristles affixed to a hollow generally cylindrical core. The brush is detachably mounted to the aerosol spray can. A nozzle assembly is disposed concentrically within the hollow cylindrical core of the brush. The nozzle assembly includes a plurality of aerosol spray nozzles in communication with one another. The nozzles can be aligned to spray in the same general direction or in directions angularly separated from one another. The nozzle assembly includes an axial extension which enables activation of the spray from the portion of the brush and aerosol spray assembly opposite the spray can. The brush also can be provided with a trigger lever which enables activation of the spray with the hand in which the spray can is held. As a result of this construction the aerosol spray can assembly enables easy and simultaneous use of the brush and spray with one hand thereby leaving the other hand free to employ another hair grooming tool such as a blow dryer. The construction is equally acceptable to use by a person grooming themselfes or another.

While the subject invention has been described and illustrated with respect to certain preferred embodiments, it is obvious that various modifications can be made therein without departing from the spirit of the subject invention which should be limited only by the scope of the appended claims.

What is claimed is:

1. A hairbrush and aerosol spray assembly comprising:

an aerosol spray can having opposed top and bottom ends, a can nozzle extending from said top end thereof, and mounting means disposed adjacent said top end;

a nozzle assembly detachably mounted to said can nozzle, said nozzle assembly including a plurality of nozzle heads in communication with one another and operative to emit a dispersed spray of material from said spray can;

a brush comprising a generally cylindrical hollow core disposed generally concentrically around said nozzle assembly, a plurality of bristles extending generally radially outwardly from said core, said core being formed with spray aperture means disposed to enable a flow of the spray from said nozzle heads, a base securely attached to said core and detachably mounted to said mounting means on said spray can; and first and second independently operable activating means for activating the spray, said first activating means comprising an extension integral with said nozzle assembly and protruding beyond the end of said core such that pressure on said extension activates the spray, said second activating means comprising a trigger lever extending through the brush base and detachably mounted to said nozzle assembly, said trigger lever being movable with respect to said base such that movement of said trigger lever causes a corresponding movement in said nozzle assembly to activate the spray.

2. A hairbrush and aerosol spray assembly as in claim 1 wherein said mounting means comprises an array of threads, and wherein the base of said brush includes an array of threads mounted to said mounting means.

3. A hairbrush and aerosol spray assembly as in claim 1 wherein said brush is frictionally engaged on said mounting means of said spray can.

4. A hairbrush and aerosol spray assembly as in claim 3 wherein the base of said brush is defined by a plurality of key ways and wherein said mounting means on said can comprises a plurality of keys dimensioned and disposed to be frictionally engaged by the key ways on said brush.

5. A hairbrush and aerosol spray assembly as in claim 1 wherein said brush includes a plurality of locking hooks and wherein said mounting means includes a plurality of locking loops disposed and dimensioned to engage said locking hooks, said assembly further comprising spring means for urging said locking hooks into engagement with said locking loops.

6. A hairbrush and aerosol spray assembly as in claim 1 wherein said mounting means comprises a looped fabric mounted to said spray can and wherein said base of said brush includes a hooked fabric attachable to said looped fabric.

7. A hairbrush and aerosol spray assembly as in claim 6 wherein said base includes an arcuate mounting flange to which said hooked fabric is attached.

8. A hairbrush and spray assembly as in claim 1 wherein said brush is formed from plastic.

9. A hairbrush assembly for mounting on a generally cylindrical aerosol spray can having opposed top and bottom ends and a can nozzle extending from the top end thereof, said brush assembly comprising:

a brush comprising an elongated hollow core having aperture means for emitting a spray from the can, a plurality of bristles extending radially outward from said core along substantially the entire length thereof and from various angular positions with respect thereto, a base attached to said core and dimensioned and configured to mount to the top of said spray can, a nozzle assembly disposed centrally within said core and dimensioned to be connected into communication with the can nozzle, said nozzle assembly including a plurality of nozzle heads disposed along the length of said core and adapted to each emit spray of material from said can, said nozzle assembly being movable within said core and being longer than said core such that one end of said nozzle assembly extends beyond the core and can be moved relative to said core to activate the spray, said assembly further including a trigger lever slideably mounted in said base and detachably mounted to said nozzle assembly, whereby when said brush is mounted to said spray can movement of said trigger lever causes a corresponding movement in said nozzle assembly to activate the spray.

10. A hairbrush assembly as in claim 9 wherein the aperture means in said core defines a separate spray emitting aperture for each said nozzle head.

11. A hairbrush assembly as in claim 9 wherein the aerosol spray can comprises an array of external threads thereon and wherein the base of said brush comprises an array of internal threads dimensioned to be mounted on the external threads of said can.

12. A hairbrush assembly as in claim 9 wherein the nozzle heads are aligned to spray in generally the same direction.

13. A hairbrush assembly as in claim 9 wherein the nozzle heads are aligned to spray in different directions.

14. A hairbrush and aerosol spray assembly comprising:

an aerosol spray can having opposed top and bottom ends, a can nozzle extending from said top end thereof, and at least one loop mounted to the top end of said can;

a nozzle assembly detachably mounted to said can nozzle, said nozzle assembly including at least one nozzle head in communication with said can nozzle and operative to emit a dispersed spray of material from said spray can;

a brush comprising a generally cylindrical hollow core disposed generally concentrically around said nozzle assembly, a plurality of bristles extending generally radially outwardly from said core, said core being formed with spray aperture means disposed to enable a flow of the spray from said nozzle head, a base securely attached to said core, said base including at least one hook engagable with the loop on the top end of said can;

spring means disposed intermediate said top end of said can and said brush for biasing the hook of said brush into engagement with the loop on said can; and at least one activating means for activating the spray.

15. A hairbrush and aerosol spray assembly as in claim 14 wherein said can includes a pair of loops and wherein said brush includes a pair of hooks dimensioned and located to securely engage the loops on the can.

* * * * *